US006814606B2

(12) United States Patent
Kobayashi

(10) Patent No.: US 6,814,606 B2
(45) Date of Patent: Nov. 9, 2004

(54) ELECTRICAL CONNECTOR LOCKING SYSTEM

(75) Inventor: Nobuchika Kobayashi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/692,784

(22) Filed: Oct. 27, 2003

(65) Prior Publication Data

US 2004/0092150 A1 May 13, 2004

(30) Foreign Application Priority Data

Nov. 8, 2002 (JP) ..... 2002-325067

(51) Int. Cl.[7] ..... H01R 13/62

(52) U.S. Cl. ..... 439/372; 439/299; 439/924.2; 439/144

(58) Field of Search ..... 439/372, 157, 439/160, 144, 133, 135, 137, 142, 924.2, 299

(56) References Cited

U.S. PATENT DOCUMENTS 2,930,103 A * 3/1960 Stanley ..... 28/244
2,987,693 A * 6/1961 Wamsley ..... 439/157
3,035,243 A * 5/1962 Bowling ..... 439/160
5,017,147 A * 5/1991 Sugiyama et al. ..... 439/144
5,139,432 A * 8/1992 Sugiyama et al. ..... 439/372
5,464,351 A * 11/1995 Oka ..... 439/372
5,593,313 A * 1/1997 Shibuya et al. ..... 439/373
6,132,235 A * 10/2000 Kitada ..... 439/372
6,361,336 B1 * 3/2002 Zhao et al. ..... 439/157
6,554,628 B2 * 4/2003 Aleshevich et al. ..... 439/160

FOREIGN PATENT DOCUMENTS

JP 5-45063 11/1993
JP 10-069942 3/1998
JP 2002-075535 3/2002

OTHER PUBLICATIONS

English Language Abstract of JP 10–069942.
English Language Abstract of JP 2002–075535.

* cited by examiner

*Primary Examiner*—Tho D. Ta
(74) *Attorney, Agent, or Firm*—Greenblum & Bernstein, P.L.C.

(57) ABSTRACT

An electrical connector locking system includes a first connector receptacle provided on an electrical connector box, a lock cover joinable to a first electrical connector inserted to the first connector receptacle, and a first engagement portion provided on the lock cover. The lock cover is pivotably supported by a pivot base and the first engagement portion is engageable with a second engagement portion provided on the first electrical connector. A double locking mechanism is thus formed by the first electrical connector engaging with the first connector receptacle upon insertion therein, and by the lock cover pivoting to a position where the first engagement portion engages with the second engagement portion on the first electrical connector.

11 Claims, 7 Drawing Sheets

ELECTRICAL CONNECTOR LOCKING SYSTEM

1. Field of the Invention

The invention relates to a locking mechanism for an electrical connector; specifically, a locking mechanism that prevents the separation of a connector from the opposing connector to which it is joined.

2. Description of Related Art

A double locking mechanism is conventionally employed to increase the security of an electrical connection by preventing an electrical connector, which is attached to the terminal end of a wiring harness, from separating from a connector receptacle in an electrical connector box. FIG. 6A illustrates such locking mechanism as described by Japanese Utility Model Patent H5-45063.

As shown in FIG. 6A, first receptacle 2 is located adjacent to second receptacle 3 on the external surface of electrical connector box 1. Lock cover 4, which is generally L-shaped in cross section, is pivotably supported by a pivot base located between connector receptacles 2 and 3 through pivot pin 5, and energized by coil spring 6 installed to the pivot pin 5. The energy from coil spring 6 is applied in a direction that presses lock cover 4 against the top of connector receptacle 3. Moreover, latch window 4*a* is formed on the side of lock cover 4, and latch pawl 2*a* is formed on the sidewall of first receptacle 2 at a location corresponding to that of latch window 4*a*.

As shown in FIG. 6B, after first connector 7 (which is connected to the ends of wiring harness wires) is installed within first receptacle 2, lock cover 4 is pivoted against the pressure applied by coil spring 6 in order to bring latch window 4*a* to a position that engages latch pawl 2*a* on first receptacle 2. A double locking mechanism is thus formed in which lock cover 4 presses downward on first connector 7 as means of preventing connector 7 from loosening, and also as means of preventing connector 7 from being installed incompletely.

Second connector 8 is installed to second receptacle 3 after lock cover 4 has been pivoted to the locking position over first connector 7. Second connector 8 cannot be installed to second receptacle 3 if lock cover 4 has not been moved to the position locking first connector 7. A mechanism is thus formed insuring that lock cover 4 will be placed in the locking position before the insertion of second connector 8.

The structure shown in FIGS. 6A and 6B demonstrates an inherent shortcoming in that shocks induced by transport and/or attachment of the connector box to the vehicle may result in the inadvertent pivoting movement of lock cover 4 to the extent that latch window 4*a* accidentally engages latch pawl 2*a*, even though coil spring 6 energizes lock cover 4 in the unlocking direction. In this case, a special tool must be used to release lock cover 4, thus necessitating a troublesome and time-consuming operation to return lock cover 4 to an unlocked position.

Furthermore, component costs increase because the prior art structure requires that a separate energizing component, in the form of coil spring 6, be used to energize lock cover 4. Moreover, the expense and time required for the extra assembly operation, through which coil spring 6 must be installed to pivot pin 5, also increases.

SUMMARY OF THE INVENTION

The invention, having considered the aforesaid shortcomings of the prior art structure, puts forth an electrical connector locking mechanism capable of preventing accidental engagement of the lock cover before the electrical connector is installed, reducing component cost, and improving the efficiency of the connector installation process.

The invention resolves the prior art shortcomings and provides an electrical connector locking system that includes a first connector receptacle provided on an electrical connector box; a lock cover joinable to the first electrical connector insertable into the first connector receptacle, and a first engagement portion provided on the lock cover. The lock cover is pivotably supported by a pivot base and the first engagement portion is engageable with a second engagement portion provided on the first electrical connector.

A double locking mechanism is thus formed by the first electrical connector engaging with the first connector receptacle upon insertion therein, and by the lock cover pivoting to a position where the first engagement portion engages with the second engagement portion on the first electrical connector.

Because the aforesaid engagement portion is provided on the electrical connector rather than the receptacle, the above-described structure is able to prevent the engagement portion on the lock cover from joining to the engagement portion on the electrical connector when the electrical connector box is in transport or being installed to the vehicle; that is, the time during which the electrical connector is not installed to the connector receptacle in the connector box. The lock cover is thus prevented from accidentally moving to the locked position when the electrical connector is not present in the receptacle.

Moreover, after the electrical connector and receptacle have been joined, separation of the connector from the receptacle is prevented, as well as its partial connection thereto, as a result of the double locking structure enforced together with the lock cover. Furthermore, the invention provides a highly dependable non-loosening circuit connection for important safety-related electrical circuits such as those used for the deployment of an automotive airbag.

The aforesaid electrical connector locking system may be provided with an interference flange located in a vicinity of the first connector receptacle, and a stopper block provided on the lock cover. The stopper block is engageable with the interference flange to restrict the pivoting movement of the lock cover and to keep the lock cover away from the first connector receptacle.

Pivoting movement of the lock cover toward the first connector receptacle results in the stopper block riding over the interference flange, and the first engagement portion of the lock cover engaging with the second engagement portion of the first electrical connector.

The electrical connector locking system may further include a second connector receptacle configured to receive and engage with a second electrical connector.

The pivot base can be located between the first connector receptacle and the second connector receptacle, and the lock cover is pivotable between the first connector receptacle and the second connector receptacle. The interference flange can be located between the first connector receptacle and the second connector receptacle. The lock cover prevents insertion of the second electrical connector in the second connector receptacle when the interference flange contacts the stopper block. The pivoting movement of the lock cover into engagement with the first connector receptacle allows the insertion of the second electrical connector to the second connector receptacle.

This structure eliminates the coil spring, which was previously required to hold the lock cover in an unlocked position, because the lock cover can be maintained at the second receptacle side, at the open position, through the friction created by the stopper block being placed in contact with the interference flange. This structure thus reduces the number of connector box components, eliminates the assembly operation for one component, and reduces the number of manufacturing steps.

Moreover, the second connector cannot be inserted into the second receptacle if the lock cover is not engaged to the first connector when the first connector has been inserted into the first receptacle. The insertion operation of the second connector thus assures that the technician has forcefully moved the lock cover into the engaged position over the first connector.

Furthermore, a stopper block contact edge may be provided including an upper edge on a second connector receptacle side of the interference flange, and a deflection portion is provided on the stopper block and is engageable with the stopper block contact edge, so as to form a contact between the interference flange and the stopper block.

This structure allows the deflection portion to press against the upper edge of the interference flange as means of forming a temporary frictional joint therebetween, but also allows the technician to easily release the joint by pivoting the lock cover with the deflection portion riding over the upper edge of the interference flange.

The pivot base can be formed on the external surface of the first connector receptacle, or can protrude from a case of the electrical connector box adjacent to the first connector receptacle. Further, the first engagement portion may be a latch window and the second embodiment portion may be a latch engagement tab that engages with the latch window.

The lock cover can include a pair of support arms supported by the pivot base; an upper wall that is substantially oriented at 90 degrees to the upper edge of the pair of support arms, the upper wall configured to press against the first electrical connector; sidewalls that extend from both sides of the upper wall each having a latch window as the first engagement portion. The latch window is engageable with a latch engagement tab as the second engagement portion. The stopper block being formed between the pair of support arms under the upper wall.

Preferably, the first connector receptacle includes a locking lip located within the first connector receptacle. The locking lip is engageable with the first electrical connector.

In another aspect of the present invention, in combination with an electrical connector, an electrical connector locking system includes a first connector receptacle provided on an electrical connector box, the first connector receptacle configured to receive and engage with the electrical connector; a lock cover joinable to the electrical connector insertable into the first connector receptacle, the lock cover being pivotably supported by a pivot base; a first engagement portion provided on the lock cover; and a second engagement portion provided on the electrical connector. The first engagement portion is engageable with the second engagement portion. Thus, a double locking mechanism is formed by the electrical connector engaging with the first connector receptacle upon insertion therein, and by the locking cover pivoting to a position where the first engagement portion engages with the second engagement portion on the electrical connector.

The combination may include an interference flange located in the vicinity of the first connector receptacle, and a stopper block provided on the lock cover. The stopper block is engageable with the interference flange to restrict the pivoting movement of the lock cover and to keep the lock cover away from the first connector receptacle. Pivoting movement of the lock cover toward the first connector receptacle results in the stopper block riding over the interference flange, and the first engagement portion of the lock cover engages with the second engagement portion of the electrical connector.

The combination may further include a second connector receptacle configured to receive and engage with another electrical connector. The pivot base is located between the first connector receptacle and the second connector receptacle, and the lock cover is pivotable between the first connector receptacle and the second connector receptacle. The interference flange is located between the first connector receptacle and the second connector receptacle. The lock cover prevents the insertion of another electrical connector in the second connector receptacle when the interference flange contacts the stopper block. The pivoting movement of the lock cover into engagement with the first connector receptacle allows the insertion of another electrical connector to the second connector receptacle.

The combination may additionally include a stopper block contact edge, which includes an upper edge on a second connector receptacle side of the interference flange, and a deflection portion provided on the stopper block and is engageable with the stopper block contact edge, so as to form a contact between the interference flange and the stopper block.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

Figure 1:
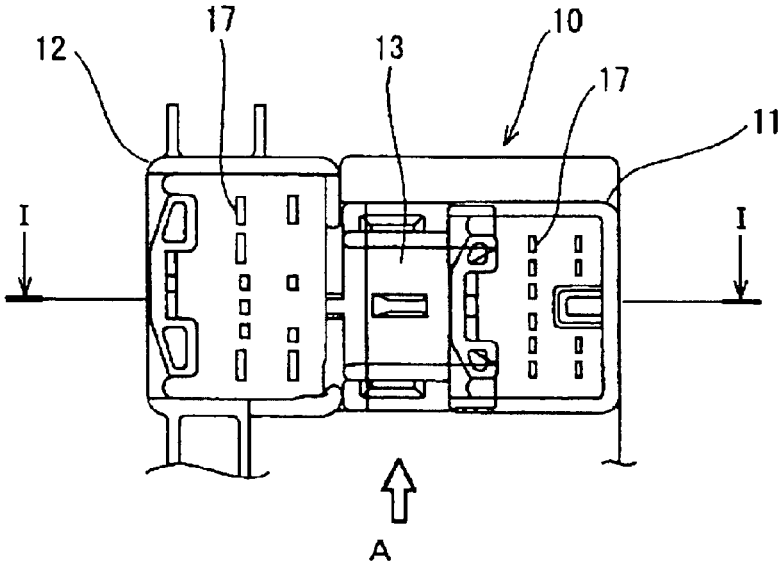
FIG. 1 is a top view of a connector locking mechanism according to an embodiment of the present invention.
Figure 2:
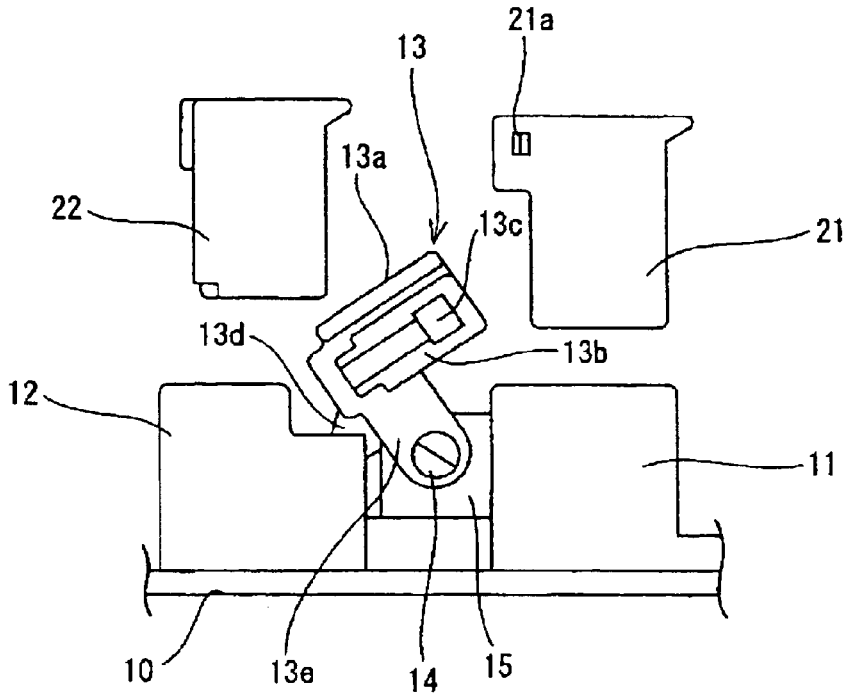
FIG. 2 is a view of the connector receptacles from side "A" shown in FIG. 1.

The following will describe embodiments of the present invention with reference to the attached drawings. As illustrated in FIGS. 1 and 2, first and second receptacles 11 and 12 extend from the upper surface of synthetic resin electrical connector box 10, pivot base 15 is formed in the vicinity of first receptacle 11 and between first and second receptacles 11 and 12, and lock cover 13, which is L-shaped in cross section, is pivotably attached to pivot base 15 through pivot pin 14. The pivot base 15 can be formed on the external surface of the first receptacle 11 or can protrude from the connector box 10.

Bus bar tabs 17 for an airbag circuit protrude into the internal area of first receptacle 11 and join to first connector 21 which is attached to terminal ends of the wire harness for the airbag circuit. Latch engagement tab 21*a* protrudes from an external wall of the housing part of first connector 21.

Bus bar tabs 17 for a non-airbag circuit protrude into the internal region of second receptacle 12, and join to second connector 22 which is attached to the terminal ends of the wire harness for the non-airbag circuit.

First connector 21 incorporates a conventional locking mechanism that engages with locking lip 11*a* located within first receptacle 11. Similarly, second connector 22 incorporates a conventional lock mechanism that engages with locking lip 12*a* located within second receptacle 12 (see FIG. 3A).

Synthetic resin lock cover 13 has a pair of support arms 13*e* which is supported by pivot base 15 via pivot pin 14, upper wall 13*a* that may press against first connector 21 which is substantially oriented at 90 degrees to the upper edge of support arm 13*e*, sidewalls 13*b* that extend from both sides of upper wall 13*a*, and latch window 13*c*, formed on the aforesaid sidewall 13*b*, that engages latch engagement tab 21*a* on first connector 21.

Figure 3A:
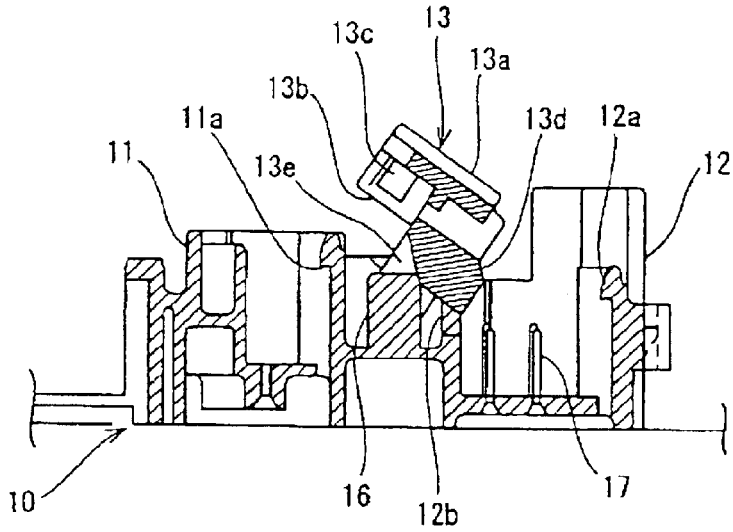
FIG. 3A is a front cross section taken from line I—I in FIG. 1.

As shown in FIG. 3A, stopper block 13*d* is formed integral to and between both sides of support arms 13*e* beneath upper wall 13*a* of lock cover 13. Interference flange 16, to which stopper block 13*d* comes into contact, is formed as an integral protruding part of connector box 10 between first receptacle 11 and second receptacle 12.

Figure 3B:
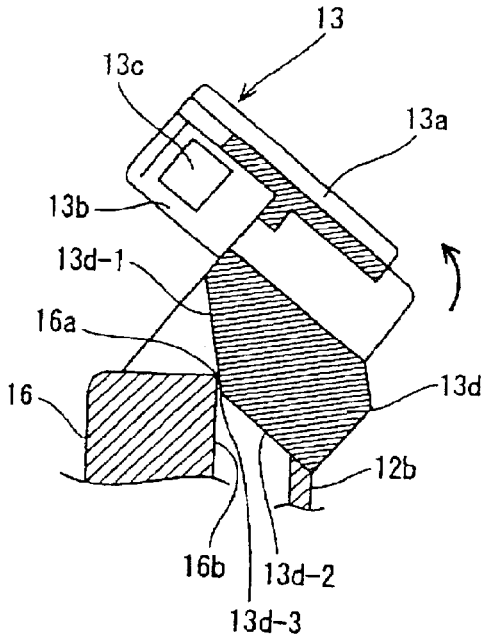
FIG. 3B is an enlarged detailed view of a portion of the FIG. 3A cross section.

As illustrated by the enlarged view in FIG. 3B, stopper block 13*d* incorporates deflection part 13*d*-3 that includes lower surface 13*d*-2 oriented parallel to upper wall 13*a*, and tapered part 13*d*-1 inclined upwardly from lower surface 13*d*-2. Tapered part 13*d*-1 is placed in physical contact with upper edge 16*a* of interference flange 16, while lower surface 13*d*-2 is supported by the upper edge of sidewall 12*b* of second receptacle 12.

This structure is able to temporarily maintain the position of lock cover 13 away from the first receptacle by preventing its inadvertent pivoting movement in the direction shown by the arrow in FIG. 3B, and also maintain lock cover 13 in a position that blocks the upward facing opening of second receptacle 12.

FIG. 3B shows lock cover 13 in the temporarily secured open position in which tapered part 13*d*-1 of stopper block 13*d* is slightly inclined in relation to the side surface 16*b* of interference flange 16. When lock cover 13 pivots in the direction shown by the arrow in the figure, stopper block 13*d* is able to easily ride over upper edge 16*a* of interference flange 16.

Figure 3C:
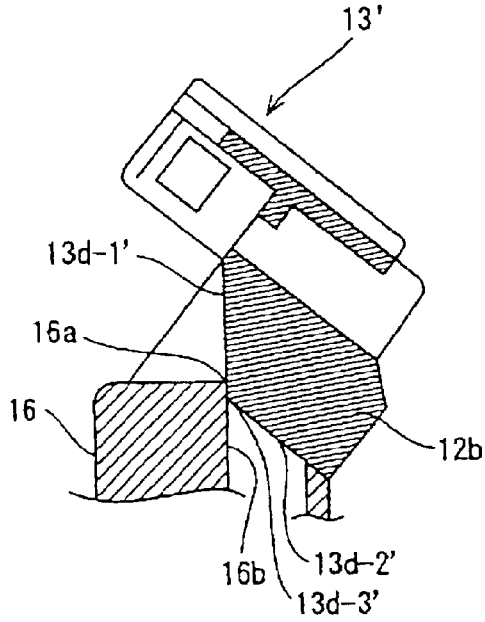
FIG. 3C is an enlarged detailed view of a modified version of a portion of the FIG. 3A cross section.

FIG. 3C illustrates a modified version of this structure in which tapered part 13*d*-1' of stopper block 13*d*' may be in contact with interference flange 16 parallel to side surface 16*b* of interference flange 16.

The following will describe the procedure through which first and second connectors 21 and 22 are respectively joined to first and second receptacles 11 and 12.

Figure 4:
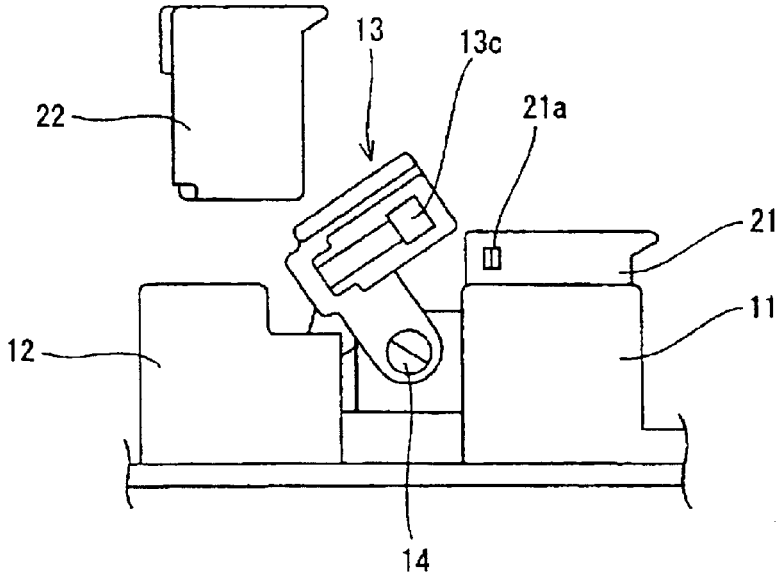
FIG. 4 is a side view of the first connector installed to the first receptacle.

Initially, as shown in FIG. 4, first connector 21 is inserted into first receptacle 11, and locked in position through engagement to locking lip 11*a* (FIG. 3A).

Figure 5A:
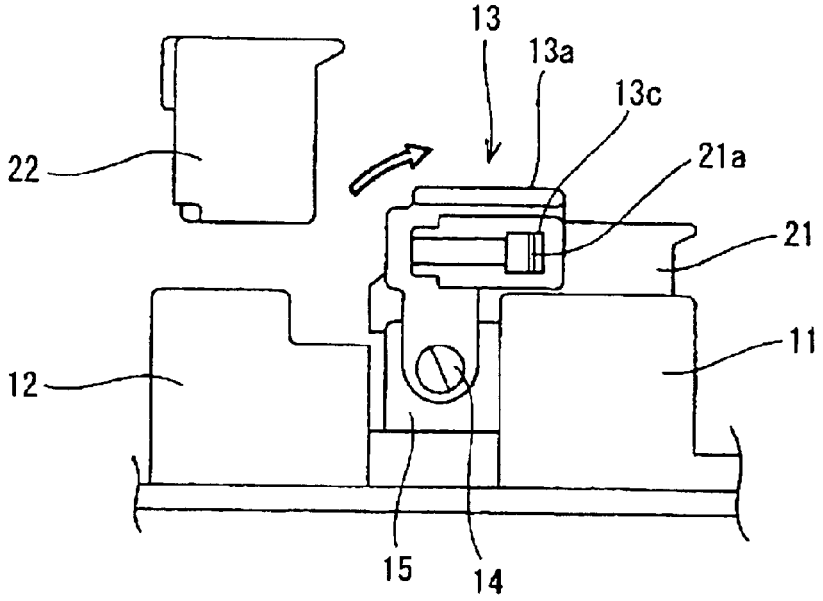
FIG. 5A is a side view of the cover in a locked position over the first connector.
Figure 5B:
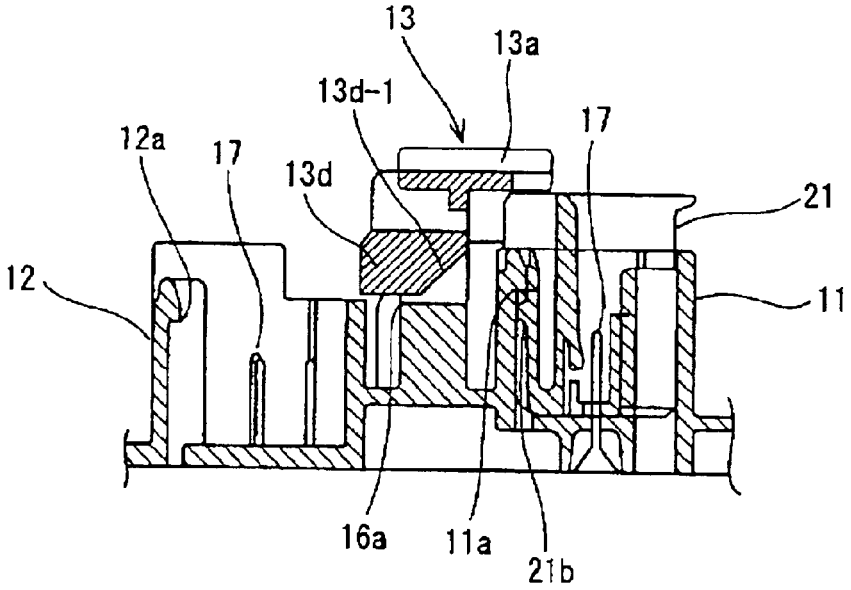
FIG. 5B is a cross section of the FIG. 5A view.
Figure 6A:
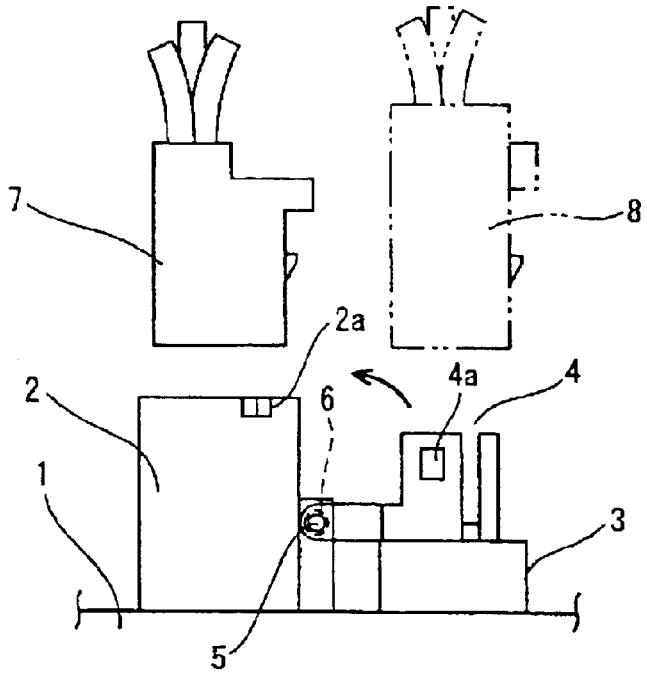
FIG.6A Prior Art
FIGS. 6A and 6B are illustrations of a prior art connector locking mechanism.
Figure 6B:
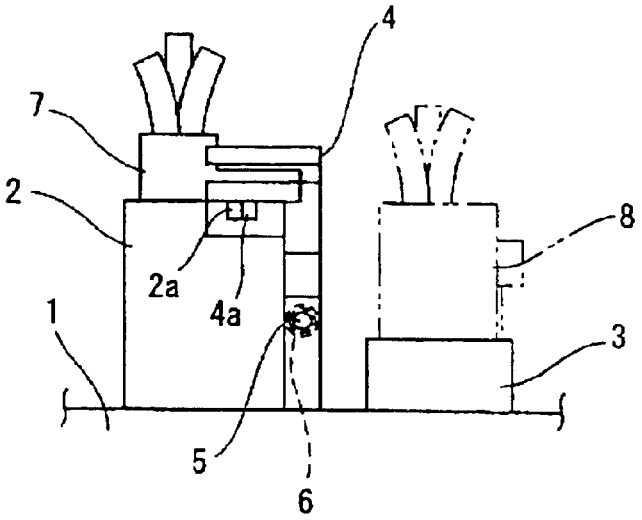
FIG.6B Prior Art

Subsequently, as shown in FIGS. 5A and 5B, the forcefully induced pivoting movement of lock cover 13 causes stopper block 13*d* to ride over upper edge 16*a* of interference flange 16, and latch window 13*c* of lock cover 13 to engage latch engagement tab 21*a* on first connector 21. Lock cover 13 is now in a position in which upper wall 13*a* presses downward on the upper edge of first connector 21, thus preventing the separation of first connector 21 from the receptacle.

The mechanism, in which first connector 21 is secured by both the engagement with first receptacle 11 and the engagement with lock cover 13, creates a double locking structure that securely and dependably maintains the connection of an important electrical circuit such as that used for airbag deployment.

Second connector 22 may now be joined to second receptacle 12 because the part of lock cover 13 that was previously blocking second receptacle 12 has moved to a position that allows access to the upward facing receptacle opening.

In other words, if lock cover 13 is not rotated to a position where latch engagement tab 21*a* engages with latch window 13*c*, lock cover 13 will continue to block access to second receptacle 12, thus preventing the insertion of second connector 22 therein. This structure thus assures that the assembly technician will not forget to engage lock cover 13 over first connector 21.

Because the invention provides for a structure in which lock cover 13 engages with first connector 21 rather than first receptacle 11, the chance of inadvertent engagement of lock cover 13 at the locked position, that is, accidental engagement which can result from shocks induced during shipment or other operations before first connector 21 is joined to first receptacle 11, is completely eliminated. As a result, the accidental engagement of lock cover 13 to the locking position can be prevented.

Moreover, in order to maintain lock cover 13 in the unlocked position that blocks access to second receptacle 12, stopper block 13*d*, which is formed as an integral part of lock cover 13, physically contacts interference flange 16 which is formed as an integral part of the connector block case. This structure makes it possible to eliminate the coil spring used in the prior art locking mechanism, thus reducing the number of required components, eliminating the assembly operation for one component, and reducing the number of manufacturing steps.

As taught by the preceding descriptions, the invention offers an electrical connector locking mechanism in which the lock cover engages with the electrical connector rather than the connector receptacle, thus eliminating the chance of inadvertent engagement of the lock cover in the locked position, a problem that could otherwise result from shocks being applied to the electrical connector box during transport and/or other operations before the connector is joined to the receptacle. This structure thus eliminates the possibility of the cover accidentally locking in the engaged (locked) position when no electrical connector is present in the connector receptacle.

Moreover, because the stopper block comes into frictional contact with the interference flange to hold the lock cover in the unengaged position over the second receptacle, the coil spring required in the prior art structure can be eliminated, the number of components for the locking mechanism can be reduced, and a step in the assembly operation can be eliminated.

It is noted that the foregoing examples have been provided merely for the purpose of explanation and are in no way to be construed as limiting of the present invention.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2002-325067 filed on Nov. 8, 2002, the entire content of which is expressly incorporated by reference herein.

What is claimed is:

1. An electrical connector locking system, comprising:

a first connector receptacle provided on an electrical connector box, the first connector receptacle configured to receive and engage with a first electrical connector;

a lock cover joinable to the first electrical connector insertable into the first connector receptacle, the lock cover being pivotably supported by a pivot base;

a first engagement portion provided on the lock cover, the first engagement portion being engageable with a second engagement portion provided on the first electrical connector;

an interference flange located in a vicinity of the first connector receptacle; and a stopper block provided on the lock cover, the stopper block engageable with the interference flange to restrict the pivoting movement of the lock cover and to keep the lock cover away from the first connector receptacle, wherein a double locking mechanism is formed by the first electrical connector engaging with the first connector receptacle upon insertion therein, and by the lock cover pivoting to a position where the first engagement portion engages with the second engagement portion on the first electrical connector; and wherein pivoting movement of the lock cover toward the first connector receptacle results in the stopper block riding over the interference flange, and the first engagement portion of the lock cover engaging with the second engagement portion of the first electrical connector.

2. The electrical connector locking system according to claim 1, wherein the pivot base is formed on the external surface of the first connector receptacle.

3. The electrical connector locking system according to claim 1, wherein the pivot base protrudes from a case of the electrical connector box adjacent to the first connector receptacle.

4. The electrical connector locking system according to claim 1, wherein the first engagement portion comprises a latch window, and the second engagement portion comprises a latch engagement tab that engages with the latch window.

5. The electrical connector locking system according to claim 1, wherein the first receptacle includes a locking lip located within the first connector receptacle, the locking lip engageable with the first electrical connector.

6. The electrical connector locking system according to claim 1, further comprising:

a second connector receptacle configured to receive and engage with a second electrical connector, the pivot base being located between the first connector receptacle and the second connector receptacle, the lock cover being pivotable between the first connector receptacle and the second connector receptacle;

the interference flange being located between the first connector receptacle and the second connector receptacle, the lock cover preventing insertion of the second electrical connector in the second connector receptacle when the interference flange contacts the stopper block, wherein the pivoting movement of the lock cover into engagement with the first connector receptacle allows the insertion of the second electrical connector to the second connector receptacle.

7. The electrical connector locking system according to claim 6, further comprising:

a stopper block contact edge comprising an upper edge on a second connector receptacle side of the interference flange; and a deflection portion provided on the stopper block, the deflection portion engageable with the stopper block contact edge, so as to form a contact between the interference flange and the stopper block.

8. The electrical connector locking system according to claim 7, the lock cover comprising:

a pair of support arms supported by the pivot base;

an upper wall that is substantially oriented at 90 degrees to the upper edge of the pair of support arms, the upper wall configured to press against the first electrical connector;

sidewalls that extend from both sides of the upper wall each having a latch window comprising the first engagement portion, the latch window engaging with a latch engagement tab comprising the second engagement portion; and the stopper block being formed between the pair of support arms under the upper wall.

9. In combination with an electrical connector, an electrical connector locking system, comprising:

a first connector receptacle provided on an electrical connector box, the first connector receptacle configured to receive and engage with the electrical connector;

a lock cover joinable to the electrical connector insertable into the first connector receptacle, the lock cover being pivotably supported by a pivot base;

a first engagement portion provided on the lock cover;

a second engagement portion provided on the electrical connector, the first engagement portion being engageable with the second engagement portion, an interference flange located in a vicinity of the first connector receptacle; and a stopper block provided on the lock cover, the stopper block engageable with the interference flange to restrict the pivoting movement of the lock cover and to keep the lock cover away from the first connector receptacle, wherein a double locking mechanism is formed by the electrical connector engaging with the first connector receptacle upon insertion therein, and by the locking cover pivoting to a position where the first engagement portion engages with the second engagement portion on the electrical connector; and wherein pivoting movement of the lcok cover toward the first connector receptacle results in the stopper block riding over the interference flange, and the first engagement portion of the lock cover engages with the second engagement portion of the electrical connector.

10. The combination according to claim 9, further comprising:

a second connector receptacle configured to receive and engage with another electrical connector, the pivot base being located between the first connector receptacle and the second connector receptacle, the lock cover being pivotable between the first connector receptacle and the second connector receptacle;

the interference flange being located between the first connector receptacle and the second connector receptacle, the lock cover preventing the insertion of another electrical connector in the second connector receptacle when the interference flange contacts the stopper block, wherein the pivoting movement of the lock cover into engagement with the first connector receptacle allows the insertion of another electrical connector to the second connector receptacle.

11. The combination according to claim 10, further comprising:

a stopper block contact edge comprising an upper edge on a second connector receptacle side of the interference flange; and a deflection portion provided on the stopper block, the deflection portion engageable with the stopper block contact edge, so as to form a contact between the interference flange and the stopper block.

* * * * *